US005794871A

United States Patent [19]

Willetts

[11] Patent Number: 5,794,871

[45] Date of Patent: Aug. 18, 1998

[54] REMOVABLE PORTABLE DOOR LOCK

[76] Inventor: Thomas Willetts, 5 Regal Ct., St. James, N.Y. 11780

[21] Appl. No.: 802,304

[22] Filed: Feb. 18, 1997

[51] Int. Cl.[6] ..... E05C 19/18

[52] U.S. Cl. ..... 292/288; 292/DIG. 2

[58] Field of Search ..... 292/DIG. 2, 288

[56] References Cited

U.S. PATENT DOCUMENTS

| | | | |
|---|---|---|---|
| 4,022,503 | 5/1977 | Bey | 292/288 |
| 5,415,444 | 5/1995 | Hull | 292/288 |
| 5,501,494 | 3/1996 | Willetts . | |
| 5,542,723 | 8/1996 | Scharf | 292/288 |

FOREIGN PATENT DOCUMENTS

| | | | |
|---|---|---|---|
| 8480 | 1/1990 | Japan | 292/288 |

*Primary Examiner*—Flemming Saether
*Attorney, Agent, or Firm*—Galgano & Burke

[57] ABSTRACT

A portable door lock includes an interior member and an exterior member which are connected to each other by a strap. The interior member is slideable along the strap and the strap is provided with a selectively engageable mechanism for restricting movement of the interior member along the strap away from the exterior member.

9 Claims, 5 Drawing Sheets

REMOVABLE PORTABLE DOOR LOCK

BACKGROUND OF THE INVENTION

1. Field of the Invention

The invention relates to an improved removable and portable door lock. More particularly, the invention relates to an improved removable, portable door lock which is especially suitable for use with children.

2. State of the Art

Door locks provide privacy and security but present a potential hazard in the case of an emergency such as a fire. Locked doors can delay or even prevent rescue during an emergency. This potential hazard is most serious in children's rooms. For this reason, it is generally advantageous to omit locks from the doors to children's rooms. Nevertheless, there are times when children desire a certain degree of privacy, particularly from siblings, which would otherwise be provided by a door lock. These conflicting needs for privacy and safety were initially addressed for the first time in the art in my prior U.S. Pat. No. 5,501,494, the subject matter of which is incorporated herein by reference thereto. The present invention incorporates several new and useful improvements over my earlier device.

SUMMARY OF THE INVENTION

It is therefore an object of the present invention to provide an improved removable, portable door lock which is suitable for use by people of all ages and which is especially intended for use with children.

It is also an object of the invention to provide a removable, portable door lock which affords a child a certain degree of privacy while at the same time avoids the hazards associated with door locks.

It is another object of the invention to provide a removable, portable door lock which is easier and safer for a child to use.

It is still another object of the invention to provide a removable, portable door lock which is inexpensive to manufacture.

It is also an object of the invention to provide a removable, portable door lock which operates to deter entry to a room but which does not prevent entry in the case of emergency.

In accord with these objects which will be discussed in greater detail below, the removable, portable door lock of the present invention includes an interior member and an exterior member which are connected to each other by a strap. The interior member is slidable along the strap and the strap is provided with a locking or preventing means which is engageable with the interior member to prevent movement of the same along the strap away from the exterior member.

Preferably, both the interior and exterior members are truncated hollow spheres having generally circular openings which are generally dimensioned to fit over a standard door knob. The interior and exterior spheres each have a pair of slits or apertures located at diametrically opposite ends of each respective sphere opening which are dimensioned to allow facile passage of a strap therethrough. Most advantageously, the strap is anchored at one end of the exterior sphere and passed through the opposing slit. The strap then enters the interior sphere through the first interior sphere slit and passes outward through the second interior sphere slit. A selectively engageable locking mechanism is preferably mounted on the end of the strap adjacent to the interior sphere which acts to prevent the interior sphere from sliding away from the exterior sphere and off the strap when the door look is engaged.

The door lock operates by placing the exterior and interior truncated hollow spheres over both the exterior and interior door knobs, respectively, passing the strap, while loose, over the outer door edge between the interior and exterior door knobs. After the door is closed, the strap is pulled away from the anchored portion of the exterior sphere and through the interior sphere away from the door thereby reducing the distance between the two spheres to a minimum, i.e., the interior sphere is as close to the interior surface of the door as possible. Once the interior and exterior spheres are engaged in this position, the locking means can then be slideably adjusted along the strap and locked in a position to abut against the interior sphere thereby locking the same in place.

When arranged in this manner, the exterior hollow truncated sphere prevents grasping and turning of the exterior door knob. The interior sphere, the strap connecting the two spheres and the preventing means cooperate to guard against the exterior sphere from being removed from the exterior door knob without deforming or breaking the strap or the strap's attachment to one or both of the spheres.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
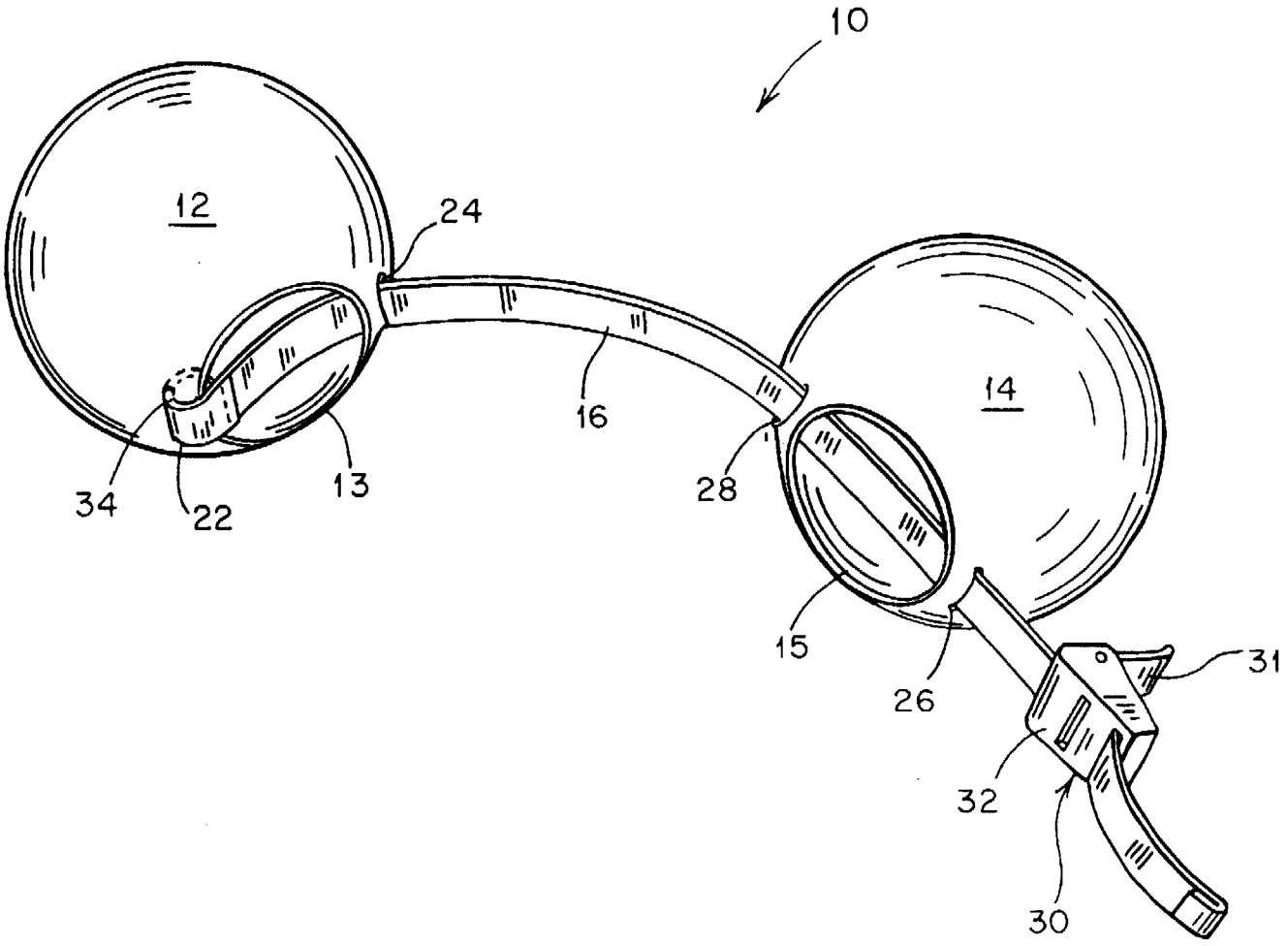
FIG. 1 is a perspective view of the door lock according to the invention.

Turning now in detail to the drawings and, in particular, FIG. 1 thereof, therein illustrated is a portable door lock according to the invention, generally designated by reference numeral 10. Lock 10 includes an exterior sphere 12, an interior sphere 14, a connecting strap 16 and a strap locking device 30. Spheres 12, 14 are preferably hollow and made of relatively rigid, yet resilient plastic material so that they are not easily deformed and are provided with generally circular openings 13, 15, respectively. Adjacent to circular openings 13, 15, the spheres 12, 14 preferably each have a pair of diametrically opposed slits 22, 24 and 26, 28 formed therein respectively, generally dimensioned for receipt of strap 16 therethrough. Circular openings 13, 15 are generally dimensioned to receive and accommodate a door knob in a relatively close-fitting manner within spheres 12 and 14, respectively, as discussed in greater detail hereinafter.

Preferably, strap 16 is anchored to exterior sphere 12 in a relatively secure manner. In the particular embodiment shown in FIG. 1, exterior sphere 12 has a first slit 24 adjacent to circular opening 13 through which strap 16 passes and a second slit 22 located adjacent to circular opening 13 diametrically opposite to first slit 24 through which a closed loop end 34 of strap 16 passes such that strap 16 is anchored to exterior sphere 12.

As further shown in FIG. 1, strap 16 further comprises a strap locking device 30 which is slideably located thereon, which, when engaged, prevents interior sphere 14 from moving along strap 16 away from exterior sphere 12. Preferably, the strap locking device comprises an airline-seat-like buckle 30 or some other simplistic locking device which children can easily operate and employ.

Figure 2A:
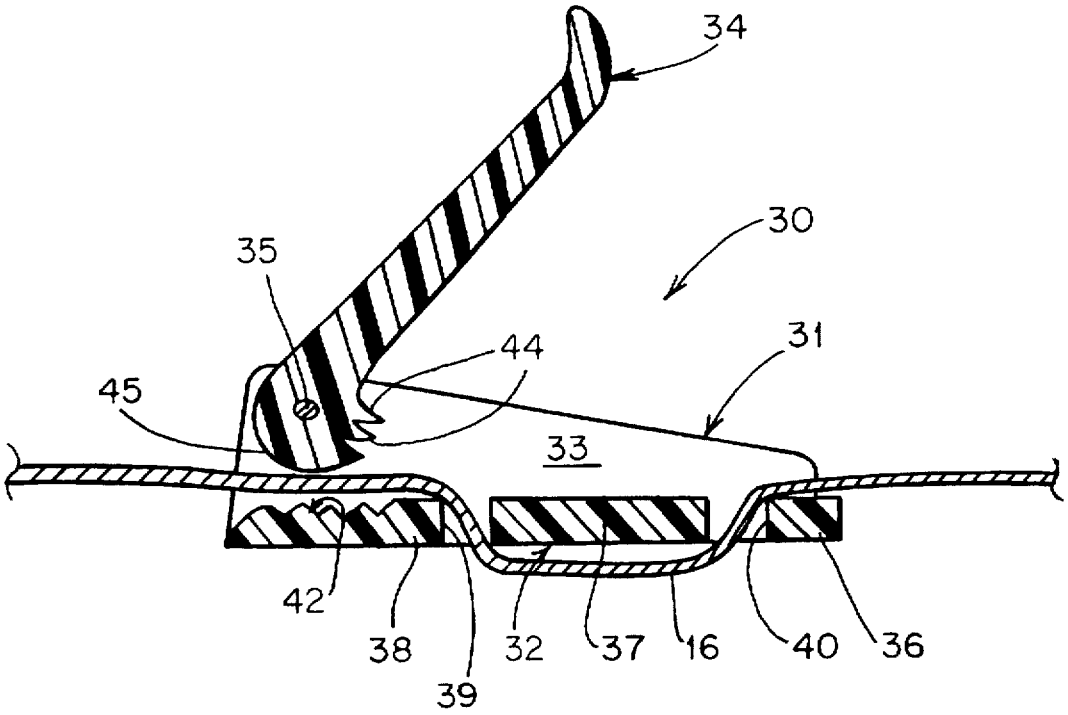
FIGS. 2*a* and 2*b* are side sectional views of the strap buckle shown in open and locked positions, respectively, on the strap.
Figure 2B:
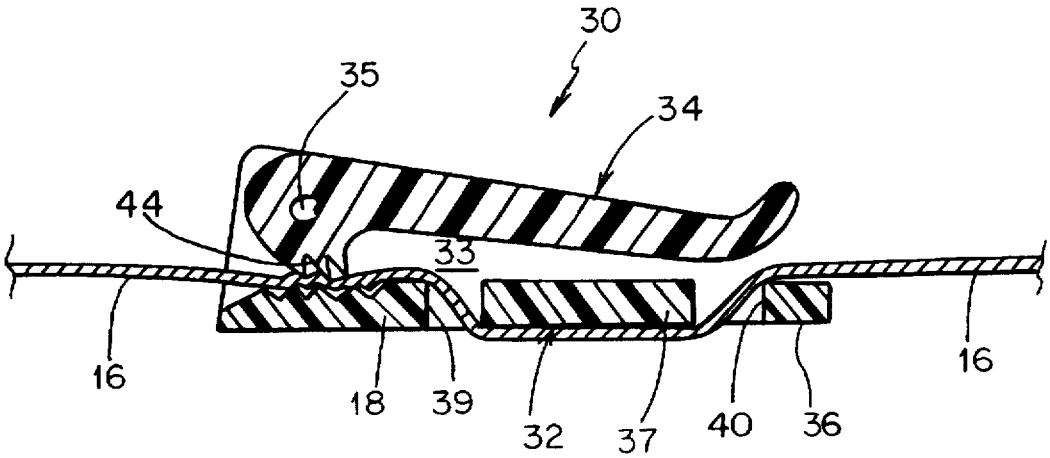

As shown in FIGS. 2*a* and 2*b*, buckle 30 comprises a generally U-shaped locking block 31 which includes a base plate 32 and a pair of upstanding side plates or wings 33. Buckle 30 further includes a locking latch arm 34 pivotably secured at end 45 via a pin 35 to side plates 33 for pivotal movement between an open position (FIG. 2*a*) and a locking position (FIG. 2*b*). Base plate 32 has a front end section 36, a middle section 37 and a rear end section 38 separated by a pair of transversely-extending slots 39, 40 dimensioned for passage of the strap 16 therethrough. The pivot end 45 of latch arm 34 is preferably provided with prongs or ratchet-like teeth 44 which are positioned to closely oppose and engage the corresponding ratchet-like toothed surface 42 of rear end section 38 when latch arm 34 is in a locking position (FIG. 2*b*). Strap 16 is secured in buckle 30 when latch arm 34 is pivoted downwardly forcing prongs 44 to engage clamp, and sandwich strap 16 against the toothed surface 42 of rear end section 38 in a tight friction-like manner.

To install buckle 30 on strap 16, strap 16 is initially fed over the rear end section 38 of buckle baseplate 32, through slot 39, under middle section 37, through slot 40 and then over front end section 36. With latch arm 34 in the open position, buckle 30 is slid along strap 16 to a desired position against interior sphere 14 (the purpose for which will be discussed in greater detail hereinafter). Latch arm 34 is then pivoted to the locking position in which strap 16 is compressingly sandwiched and frictionally clamped between the ratchet-like teeth of latch arm 34 and the ratchet-like tooth surface 42 of rear end section 38.

Figure 3:
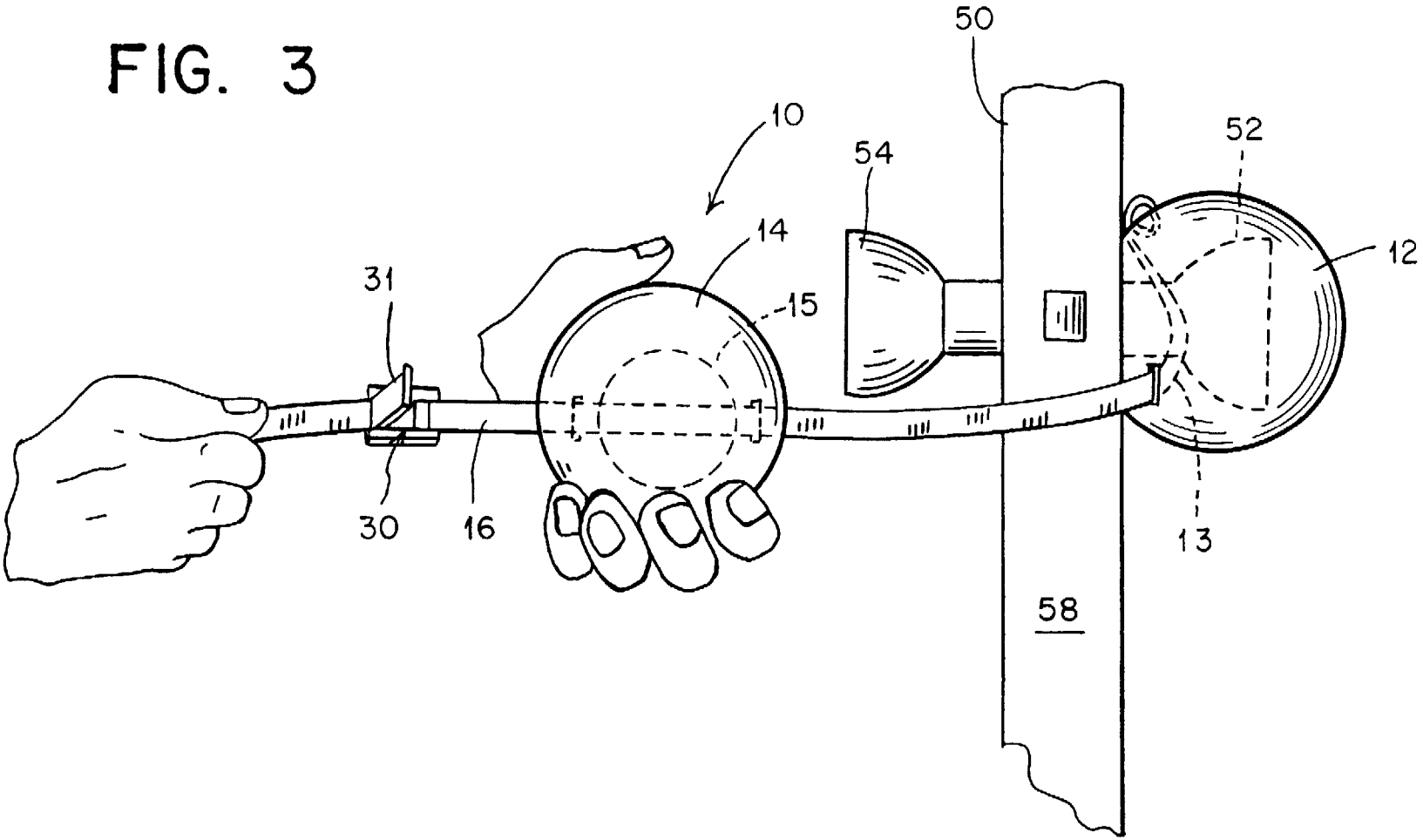
FIG. 3 is a broken side view of a door with the door lock partially mounted on the door.
Figure 4:
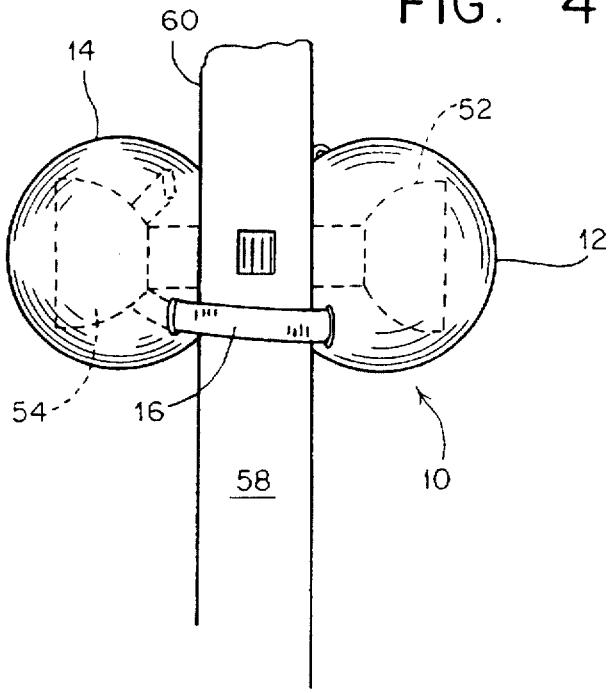
FIG. 4 is a broken side view of the door with the door lock fully mounted on the door knob of the door.
Figure 5A:
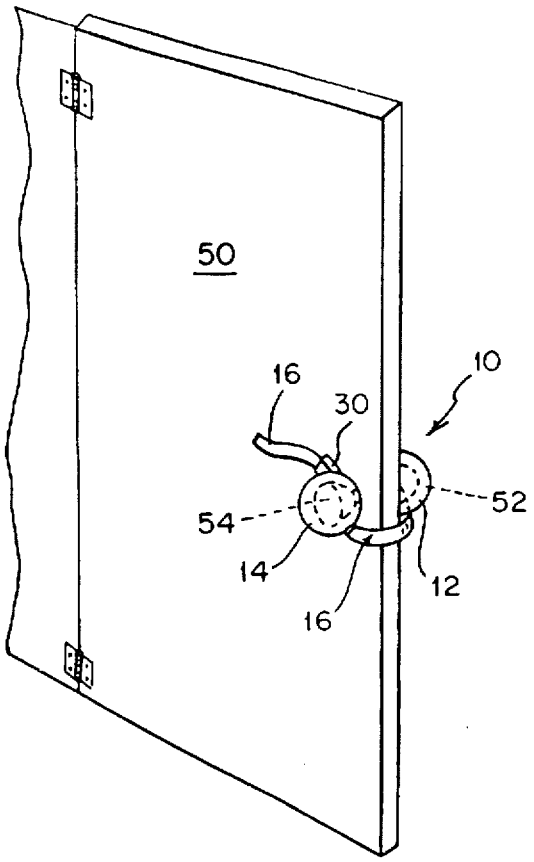
FIGS. 5*a* and 5*b* are broken perspective views of the interior side of door with the door lock fully mounted on the door knobs of the door.
Figure 5B:
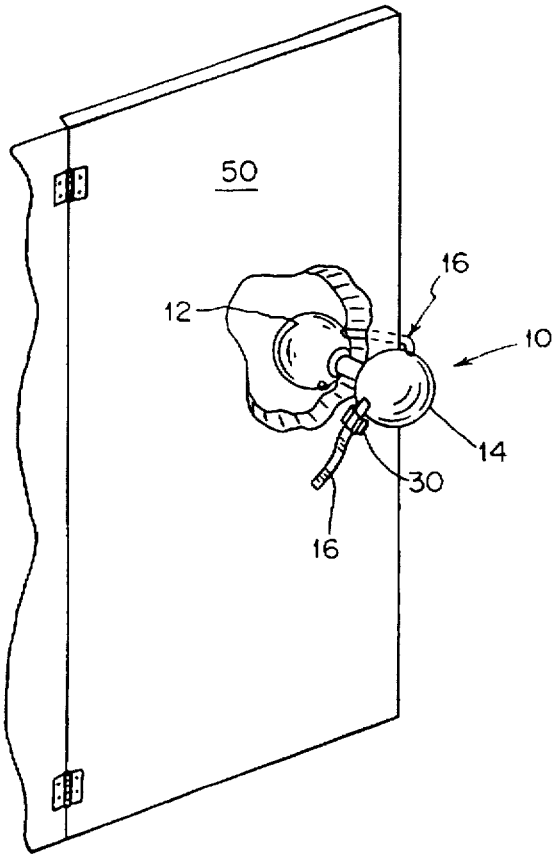

Turning now to FIGS. 3, 4, 5*a* and 5*b* door lock 10 operates as follows: Exterior sphere 12 is placed over exterior door knob 52 of door 50 and interior sphere 14 is held near interior door knob 54 of door 50 while the same is opened (FIG. 3). Door 50 is then closed slowly so that exterior sphere 12 remains on doorknob 52, interior sphere 14 remains on the interior side of door 50, and strap 16 extends through the space between door edge 58 and the door jamb (not shown). After door 50 is closed, strap 16 is pulled to bring exterior sphere 12 close up against the exterior surface of door 50 and door jamb. Interior sphere 14 is then slid along strap 16 and over door knob 54 (see FIG. 4). Strap 16 is then pulled taut and buckle 30 is then slid along strap 16 to abut against interior sphere 12. When buckle 30 is subsequently locked on strap 16 (FIGS. 4, 5*a* and 5*b*), interior sphere 12 is prevented from moving away from door 50, and, as a result, both spheres 12, 14 are prevented from moving relative to one another.

When spheres 12 and 14 are thus arranged, door 50 cannot be opened without breaking or forcibly removing lock 10 because spheres 12 and 14 abut both sides of door 50 and are relatively immovable with respect to each other.

Figure 6:
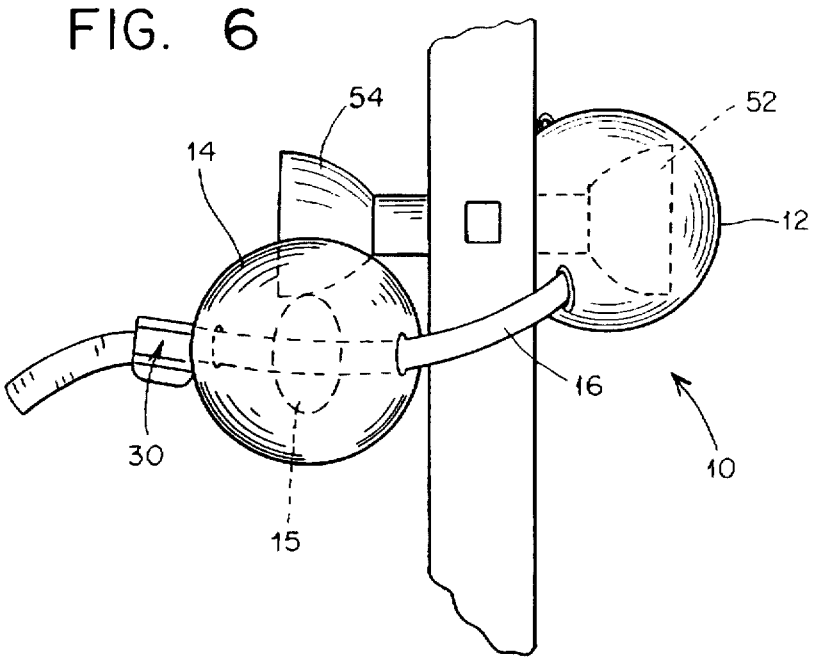
FIG. 6 is a broken side view of a door with the door lock in an alternative locking position.
Figure 7A:
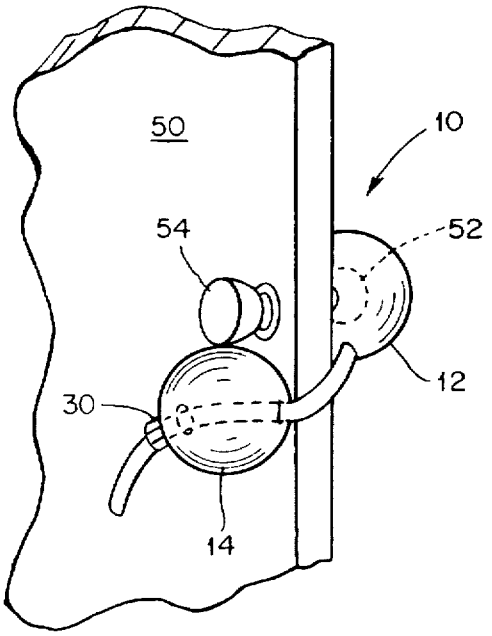
FIGS. 7*a* and 7*b* are broken perspective views of the exterior side of the door with the door lock attached to the door in the alternative locking position.
Figure 7B:
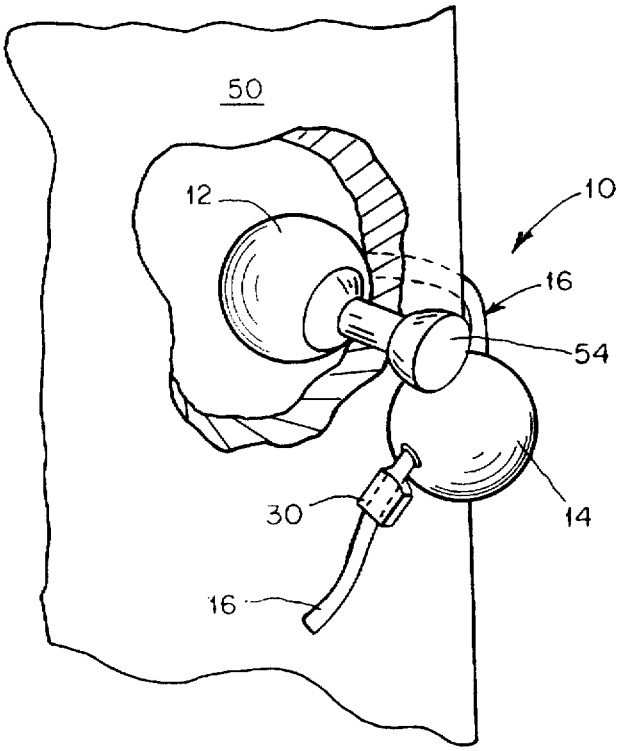

FIGS. 6, 7*a* and 7*b* depict lock 10 engaged in an alternative locking arrangement on door 50 in which exterior sphere 12 is mounted on door knob 52 and interior sphere 14 abuts against the interior surface of door 50. In this particular arrangement, strap 16 is pulled tightly through each sphere 12, 14 and around door edge 58 and buckle 30 is engaged in a locked position against interior sphere 14 which, in turn, abuts against the interior surface of door 50 (seen most clearly in FIG. 7*b*) thus preventing movement of interior sphere 14 along strap 16 away from exterior sphere 12.

As can be appreciated from the present disclosure, a person standing on the exterior side of door 50 is prevented from entering the room since exterior sphere 14 sufficiently encompasses doorknob 54 thereby preventing turning of the same which is required to open door 50. In either of the above arrangements (seen most clearly in FIGS. 5*b* and 7*b*), interior sphere 12 is held fast along strap 16 when buckle 30 is locked on strap 16 against interior sphere 12 thereby preventing movement of either sphere 12, 14 away from the other.

Various modifications may be made as will be apparent to those skilled in the art. For example, while spheres 12, 14 are preferably made of relatively rigid material so that they are not easily deformed, it may be desirable to make spheres 12, 14 from some relatively soft and/or pliable material if conditions warrant, e.g., soft or pliable plastic spheres. In addition, it may be desirable to have a strap with a relatively low tensile strength that can be easily broken by an adult thus providing only minimal security for a child vis a vis another child. Metallic spheres with a high tensile strength strap, on the other hand, will provide a relatively high level of security and may only be penetrable with the use of wire cutters or the like. Advantageously, interior sphere 14 is substantially the same size as the exterior sphere 14, however, it may be desirable to make the spheres different sizes depending upon the relative size of the door knobs or for a particular preference and/or a particular use.

While lock 10 is shown in the various figures on a door 50 which opens inward, those skilled in the art will appreciate that lock 10 will operate in the same manner with a door which opens outward. It will also be appreciated that while interior and exterior members 12, 14 shown in lock 10 are preferably spheres, objects of other shapes may also be as effective. Spheres are preferable for use by children since sharp edges are avoided. It will further be appreciated that while lock 10 is effective in hampering the opening of door 50, its efficacy is limited by the tensile strength of strap 16 and the relative strength of the strap (or sphere) when the same is secured to the spheres. Therefore, while lock 10 may be virtually 100% effective in preventing a child from opening the door, it may be easily broken by an adult in the case of an emergency.

Thus, while particular materials have been disclosed, it will be appreciated that other materials could be utilized. Also, while spheres have been shown, it will be recognized that other types of interior and exterior members could be used with similar results obtained. It is also possible to adjust the portable lock for use with other movable enclosures, such as cabinet doors or windows. Moreover, while particular configurations have been disclosed in reference to strap 16 and the buckle 30, it will be appreciated that other configurations could be used as well. For example, while FIGS. 2*a* and 2*b* depict a strap locking mechanism in the form of an airline-seat buckle, it may be desirous to have another type of strap locking mechanism such as a spring-loaded clamping device.

It will therefore be appreciated by those skilled in the art that yet other modifications could be made to the provided invention without deviating from its spirit and scope as so claimed.

What is claimed is:

1. A removable door lock, comprising:

a) an exterior member comprising a substantially hollow body having an open end, said body dimensioned to fit over and substantially cover a door knob;

b) a strap having a first end and a second end, said first end being coupled to said exterior member;

c) an interior member arranged on said strap so that it is movable along said strap toward and away from said exterior member, said interior member being a substantially hollow body having an open end, said body dimensioned to fit over and substantially cover a door knob; and d) selectively engageable means for preventing said interior member from moving along said strap away from said exterior member.

2. A removable portable door lock according to claim 1, wherein said interior and exterior members are substantially spherical.

3. A removable portable door lock according to claim 2, wherein said exterior and interior members are substantially hollow.

4. A removable portable door lock according to claim 1, wherein said exterior and interior members are substantially hollow truncated spheres which are dimensioned to fit over and substantially cover a door knob.

5. A removable portable door lock according to claim 1, wherein said preventing means comprises a strap locking mechanism.

6. A removable portable door lock according to claim 5, wherein said strap locking mechanism comprises an openable and closable buckle slideably mounted on said strap.

7. A removable portable door lock according to claim 1, further comprising means for securing said strap to said exterior member.

8. A removable portable door lock according to claim 7, wherein said strap has a looped end which serves as said securing means and which is received through said slit of said exterior member.

9. A removable portable door lock according to claim 1, wherein said exterior and interior members each has at least one slit formed thereon for passing said strap therethrough.

* * * * *